United States Patent [19]

Bell

[11] Patent Number: 4,695,204

[45] Date of Patent: Sep. 22, 1987

[54] TRAVELING TRENCH SHORE

[76] Inventor: Noel G. Bell, 52 W. Hudson Ave., Englewood, N.J. 07631

[21] Appl. No.: 873,709

[22] Filed: Jun. 12, 1986

[51] Int. Cl.[4] ..... E02D 17/00; E21D 5/12

[52] U.S. Cl. ..... 405/283; 405/282

[58] Field of Search ..... 405/136, 137, 141, 143, 405/145, 154, 158, 174, 179, 258, 272, 282, 283, 303, 159

[56] References Cited

U.S. PATENT DOCUMENTS

| | | | |
|---|---|---|---|
| 1,267,058 | 5/1918 | Clarkson | 405/283 X |
| 3,309,799 | 3/1967 | Kinkade | 405/174 X |
| 3,373,572 | 3/1968 | Kemper | 405/143 X |
| 3,541,799 | 11/1970 | Jost et al. | 405/283 |
| 3,641,773 | 2/1972 | Morrice | 405/283 |
| 3,820,345 | 6/1974 | Brecht | 405/283 |
| 3,967,454 | 7/1976 | Barnes | 405/282 |
| 4,588,329 | 5/1986 | Gilchrist | 405/283 |

FOREIGN PATENT DOCUMENTS

| | | | |
|---|---|---|---|
| 197805 | 5/1978 | Fed. Rep. of Germany | 405/145 |

*Primary Examiner*—Cornelius J. Husar
*Assistant Examiner*—Nancy J. Stodola

[57] ABSTRACT

A trench shore consisting of longitudinal panels which cover the walls of the trench and are supported by movable frames, the panels being moved forward by jacks connecting the panels to the frames which are held in place by the friction between the walls and other panels, the shore comprising a central chamber where permanent structure is installed, with a front section with sides sloping to conform to the natural slope of the ground, and a rear section with similar sloping sides to allow for tamping and consolidating backfill material around the structure installed and with bracing arranged to allow the shore to pass completed sections of manholes; the shore being also suitable for laying pipe or tunnels under water.

9 Claims, 8 Drawing Figures

TRAVELING TRENCH SHORE

This invention refers to means of shoring trench excavation. It is an improvement on that described in my U.S. Pat. No. 4,547,097 dated Oct. 15, 1985.

It provides means for constructing manholes and for tamping and consolidating backfill material around the structure installed.

The invention provides a traveling trench shore consisting of longitudinal panels which cover the walls of the trench completely and are supported by movable frames, the panels being moved forward by jacks connecting the panels to the frames which are held in place by the friction between the walls and other panels, the shore comprising a central working chamber with a front section with sides sloping to conform to the natural slope of the ground, and a rear section with similar sloping sides to allow for tamping and consolidating backfill material around the structure installed and with bracing arranged to allow the shore to pass completed sections of manholes. It also provides a shore which can be used for laying pipe or tunnels under water.

The following drawings show some embodiments of the invention:

FIG. 5 is a plan.

FIG. 6 is a vertical long section.

FIG. 7 is a cross section

FIG. 8 is a part cross section.

Figures 1, 2, 3, 4:
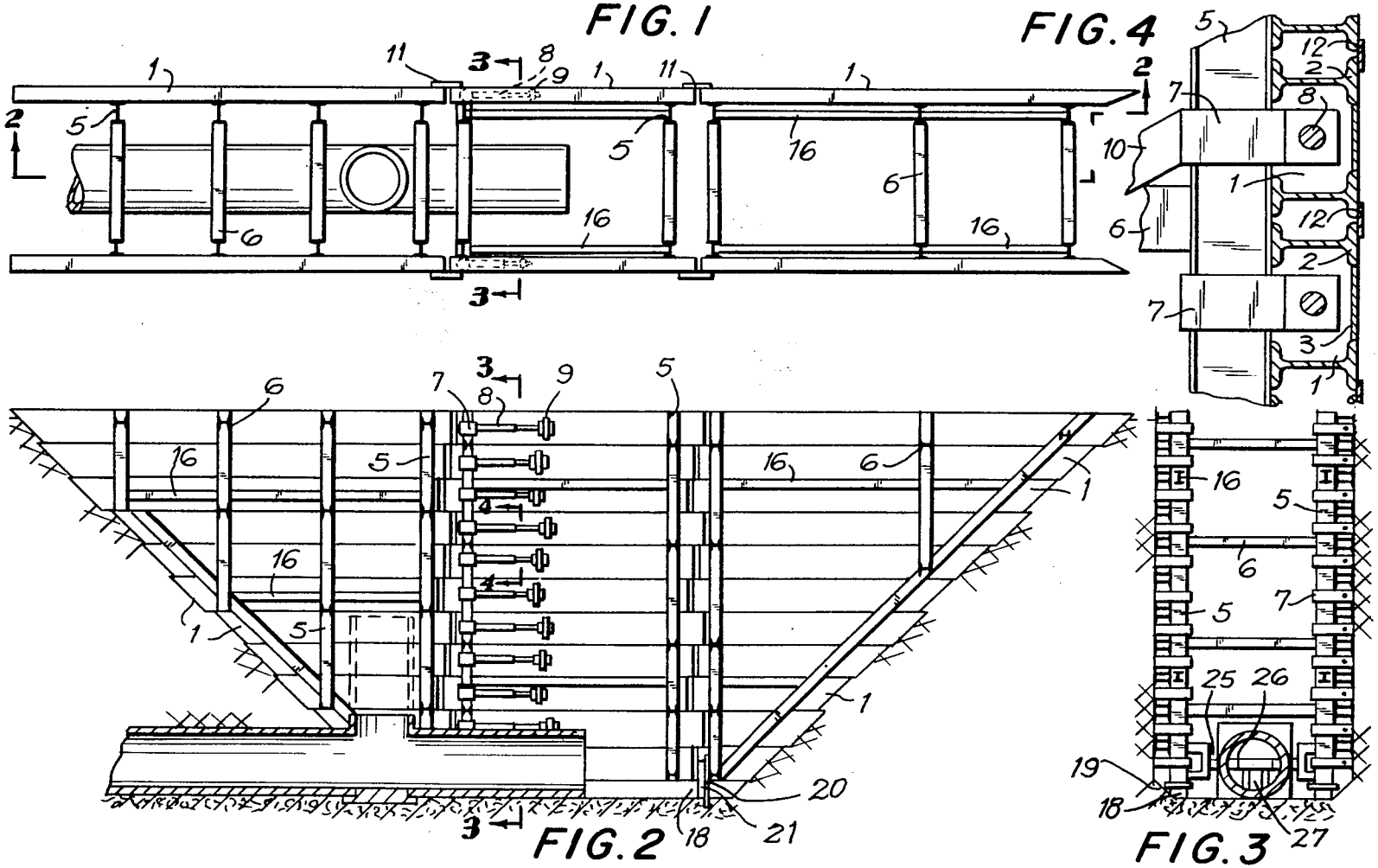
FIG. 1 is a plan.
FIG. 2 is a vertical long section.
FIG. 3 is a cross section.
FIG. 4 is a cross section, to an enlarged scale, of part of FIG. 3.
Figure 5:
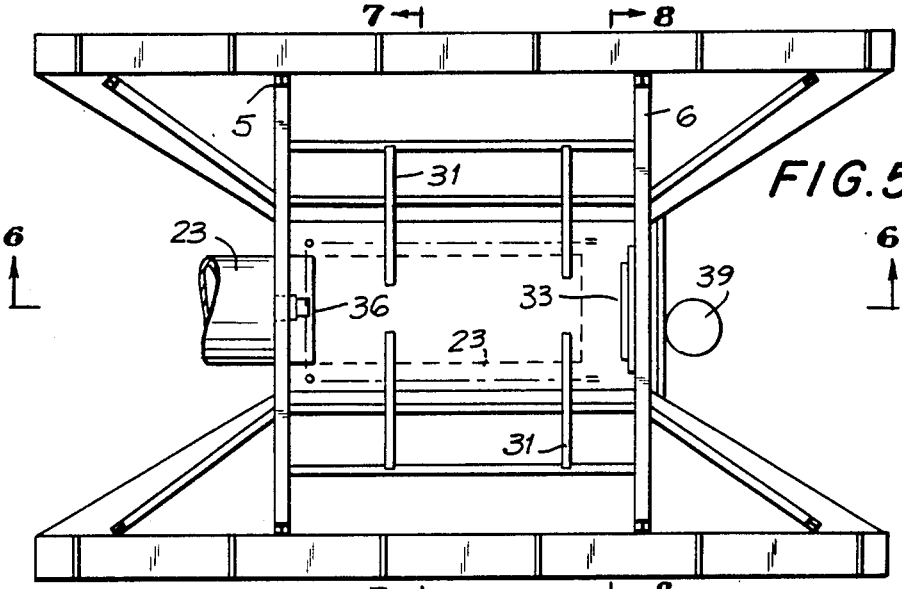
FIGS. 5 to 8 show an application of the apparatus for laying pipe or tunnels under water.
Figure 6:
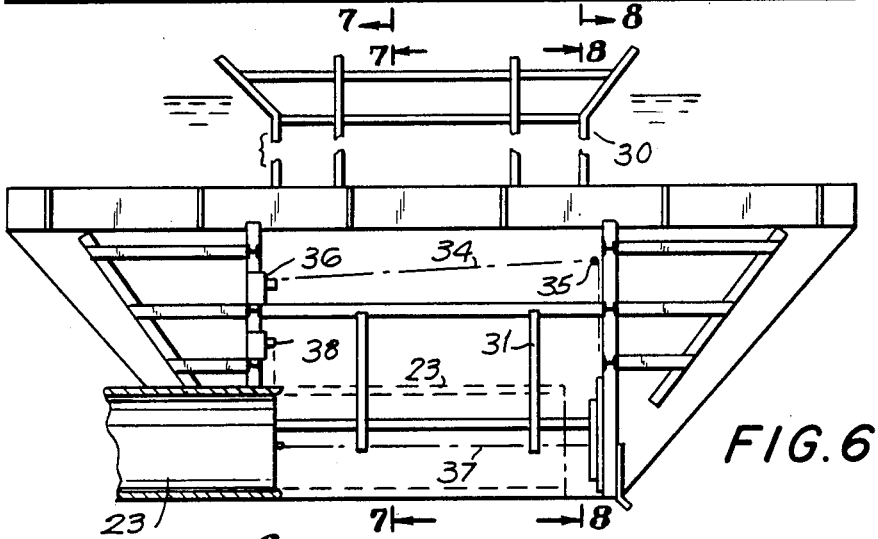
Figure 7:
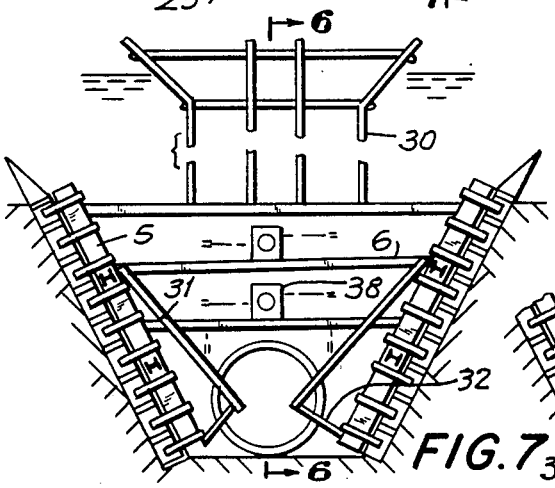
Figure 8:
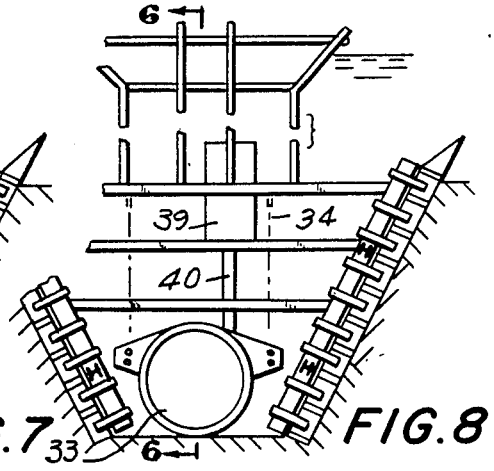

A panel 1 consist of two beams 2 joined on the outside by a plate 3 and inside by short plates. The panels are supported against earth pressure by vertical soldier beams 5 which are braced by cross braces 6. Collars 7 around the beams 5 project into the panels and form mounts for hydraulic jacks 8 whose pistons are connected to the panels by brackets 9. The collars 7 have plates 10 which engage the cross braces 6 to reduce torque on the soldier beams. The panels have cover plates 11 on their ends, as shown in FIG. 1, and cover plates 12 on their lower edges, as shown in FIG. 4, to prevent entry of earth between the panels.

Travel of a panel is effected by pushing with a jack, the reaction being taken by the soldier beam that is held in position by the other jacks which are held by the friction of the other panels. After all the panels are moved forward, the soldier beams are pulled forward by the jacks. Preferably, every third jack (counting vertically) is operated simultaneously and thus has the friction on the two stationary panels for reaction. In this way the time for travel is only limited by the time taken to move three panels plus the soldier beams, independently of the number of panels and depth of the trench. As shown in FIG. 2 the top panel has been moved forward, the second is in process and the third has not yet moved.

The panels in the front and rear sections may have jacks or may be pushed or pulled by the panels in the central section. The soldier beams 5 in the each section are connected by longitudinal ties 16 to form frames, and the frames are also connected if there are no jacks in the front and rear sections. The contacting faces of the panels and soldier beams may be coated with teflon or other friction reducting material. Alternatively dollies, consisting of an endless chain of rollers of the known type used for moving heavy loads, which roll longitudinally, may be mounted on the collars 7 on the soldier beams to allow the panels to roll forward. The prime power unit may travel alongside the trench or on top of it and the travel of the panels is controlled from a console.

The sloping walls of the rear section provide proctection for operating tamping machines, preferably gravity type, to consolidate backfill material placed on the slope as the shore moves forward. The machines may be mounted on telescopic movable arms attached to the bracing of the panels, and may have automatic remote controls. The inside face of the panels may have detachable light sheet metal covers to keep out earth.

Manholes consisting of vertical segments can be installed inside the shore by constructing the bracing of the rear section so that the lower parts of the soldier beams 5 cantilever downward below the cross braces 6, the rear end of the longitudinal tie 16 being also cantilevered to support the rear soldier beams, and diagonal beam 14 being provided to support the ends of the panels. Thus the shore can pass over each manhole segment after the segment is placed. The broken line outline 41 in FIG. 2 shows the position of the second manhole segment. The ties 16 in the rear section may be housed inside the panels and tied to the soldier beams.

As the panels and supporting frames in each section of the shore are separate from those in other sections, the shore is more flexible for negotiating curves. On horizontal curves, the jacks on the outside of the curve may be driven faster than those on the inside. On vertical curves, one end of each panel is raised in turn, the front end for upward curves and the rear end for downward curves.

In trenches where the pipe 23 or other permanent work interferes with the cross braces, the soldier beams may be made stronger to cantilever at the bottom. Alternatively, as shown in FIG. 3, the cross brace 6 where obstructed may have a dolly with concave rollers 25 which rolls longitudinally and transfers the load to the pipe. A traveling frame 27 inside the pipe with convex rollers 26 mounted opposite the concave rollers may transmit the load across the pipe and relieve the stress in it.

When there is no hydraulic jack in a panel and it is pushed by a panel behind, a flexible strut may be provided consisting of a threaded rod with a nut and hemispherical cup at each end with convex faces turned away from each other, and nesting in concave cups mounted at the ends of the panels, the ends of the rods projecting through holes in the centers of the cups and the holes having clearance to allow for deflexion of the rods. On a horizontal curve the struts on the inside of the curve may be shortened by screwing the nuts closer together. When a panel is pulled, the cups on the ends of the threaded rod are turned the oposite way and are nested in cups on the ends of the panels correspondingly turned around.

The longitudinal ties 16 of the frames may be made telescopic and have hydraulic jacks mounted on them, so as to move the transverse pairs of vertical soldier beams 5 separately, if necessary.

Vibrators may be mounted on the panels to reduce friction between the panels and the walls. Also, percussion tools may be mounted between the brackets 9 and the ends of the jack pistons, for the same purpose.

The panel walls may be set on a batter to reduce the pressure on the panels and on the bottom of the trench. A pair of crawler tracks 18 may be mounted at the bottom of the shore with a cover plate 19 attached. An adjustable dozer blade 20 and a box 21 for bedding material may be mounted a shown. Temporary well-points may be installed in the bottom of the central section and leap-frogged ahead as the shore advances.

FIGS. 5 to 8 show an application for laying pipes or tunnels under water. The sides of trenches under water stand at a fairly steep slope, even in sand if not subject to wash of waves and not left open. Therefore with panels on a batter as shown there would not be heavy pressure on the walls, and heavier soldier beams would probably be sufficient to take the loads even in deeper structures, without the complications of transferring the loads to the permanent structures.

Floatation pontoons may be attached at the top of the shore and the cross braces 6 made tubular to lighten it. Thus a lift on either end from a crane on a barge should be sufficient for negotiating vertical curves.

A telescopic fairlead cage 30 guides the pipe into place. The upper portion which has the outside tubes floats on the surface. The lower internal tubes are closed at their ends to make them buoyant and the cage is tied no-rigidly to the bracing of the shore.

Pairs of beams 31 hinged at the top and with springs 32 at the bottom cushion the landing of the pipe when it is lowered from a crane on a barge which moves with waves. When the pipe 23 (shown dotted in FIGS. 5 and 6) lands, a circular open frame 33 is lowered by cables 34 (shown chain dotted) through sheaves 35 from a winch 36 and pulled onto the end of the pipe by cables 37 from a winch 38. The winch 38 keeps a strain on the frame to prevent any tendency of the pipe to move as the shore advances. The cross braces 6 have auxillary and vertical bracing.

Evacuation may be by a dredge suction pump 39 and suction pipe 40 mounted in front of the shore with its discharge pipe leading to the rear to backfill, or by other type of dredge or by a floating dredge on the surface. A small pipe with orifices may be fitted along the nose to either suck or jet material at the leading edge. A cap may be fitted under the frame 33 to keep out dirt. A shallow hole may be excavated at the end of the pipe after laying, by a suction or airlift, to prevent any earth being dragged into the joint when the next pipe is laid.

Jacks for moving the shore may be mounted a previously described and power for the jacks, dredge pump and winches can be supplied from the crane barge on the surface.

Television cameras with lights may be used to reduce the uses of divers.

Any adaptation described in said U.S. Pat. No. 4,547,097 may be used in present shore where applicable.

I claim:

1. A traveling trench shore of the type consisting of longitudinal panels which cover the walls of the trench, the panels being supported transversely against the walls of the trench by vertical soldier beams and cross braces that form movable frames on which hydraulic jacks are mounted that are connected to the panels and move the panels forward, the reaction for the jacks being taken by the frames which are held in position by other jacks attached to other panels, which panels are held stationary by the friction between them and the walls of the trench, the panels being movable vertically and individually in succession and having plates on their lower edges and ends to cover the junction with panels below and behind them and prevent entry of earth between them; the shore comprising: a central chamber where a permanent structure is installed; a front section with walls sloping to conform to the natural slope of the ground, where excavation takes place; and a rear section with similar sloping walls to allow for installing manholes consisting of vertical segments, the vertical soldier beams of the rear section being cantilevered downwards below the lowest cross braces so that the shore can pass over each manhole segment after the segment is placed.

2. A shore as in claim 1, in which the panels and supporting frames of each section are separate from those of other sections, and the panels have plates on their outer ends to cover the junction with panels behind them, thus making the shore more flexible so that it can traverse horizontal curves by driving the jacks on the outside wall of the curve faster than those on the inside wall.

3. A shore as in claim 2, with the panels having plates on their outer lower edges to cover the junction with panels below them, thus allowing the shore to traverse vertical curves by raising one end of each panel in turn, the front end for upward curves and the rear end for downward curves.

4. A shore as in claim 1, having means for transfering the loads of the panels to the permanent structure where the structure interferes with the line of the cross braces, sais means struts with dollies, consisting of a frame with an endless chain of rollers, which roll on the structure.

5. A shore as in claim 4, having means for relieving the stress in the structure due to the loads from the panels, said means being similar to those in claim 4, mounted on a movable frame inside the structure and comprising struts with dollies which roll on the inside of the structure opposite the dollies on the outside.

6. A shore as in claim 1, the panel walls being set on a batter to reduce the pressure on the cross braces and on the bottom of the trench.

7. A shore as in claim 1, having endless crawler tracks mounted under the shore.

8. A shore as in claim 1, suitable for laying pipe or tunnels under water: which has a floating telescopic cage that is flexibly connected to the top of the shore and reaches to the surface of the water, and forms a frame to guide the pipe into the shore; the shore having pairs of spring loaded beams to cushion the landing of the pipe on the bottom of the trench.

9. A shore as in claim 8, which has means to excavate and backfill the trench, comprising a dredge suction pump and suction pipe mounted in front of the shore.

* * * * *

UNITED STATES PATENT AND TRADEMARK OFFICE

CERTIFICATE OF CORRECTION

PATENT NO. : 4,695,204

DATED : Sep. 22, 1987

INVENTOR(S) : Noel Gonne BELL

It is certified that error appears in the above-identified patent and that said Letters Patent is hereby corrected as shown below:

Claim 1, line 5, (Column 4, line 2)
After "frames" change "on" to ---to---.

line 6, (Column 4, line 3)
Change "mounted" to ---connected---.
After "that are" insert ---also---.

Signed and Sealed this
Nineteenth Day of April, 1988

*Attest:*

*Attesting Officer*

DONALD J. QUIGG

*Commissioner of Patents and Trademarks*